US007775330B2

(12) United States Patent
Kattainen et al.

(10) Patent No.: US 7,775,330 B2
(45) Date of Patent: Aug. 17, 2010

(54) UNINTENDED MOVEMENT GOVERNOR

(75) Inventors: Ari Kattainen, Hyvinkää (FI); Petteri Valjus, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/536,895

(22) Filed: Aug. 6, 2009

(65) Prior Publication Data

US 2009/0288920 A1 Nov. 26, 2009

Related U.S. Application Data

(63) Continuation of application No. PCT/FI2008/000026, filed on Feb. 12, 2008.

(30) Foreign Application Priority Data

Feb. 21, 2007 (FI) ..... 20070148

(51) Int. Cl.
*B66B 1/34* (2006.01)

(52) U.S. Cl. ..... 187/393; 187/287

(58) Field of Classification Search ..... 187/277, 187/284, 286, 287, 288, 289, 291, 305, 391–393
See application file for complete search history.

(56) References Cited

U.S. PATENT DOCUMENTS 3,961,688 A * 6/1976 Maynard ..... 187/289
4,102,436 A * 7/1978 Kernick et al. ..... 187/293
5,183,979 A 2/1993 Sheridan et al.
5,565,660 A * 10/1996 Karner ..... 187/287
6,173,814 B1 * 1/2001 Herkel et al. ..... 187/288
6,186,281 B1 * 2/2001 Pietrzykowski et al. ..... 187/287
7,537,090 B2 * 5/2009 Vantanen ..... 187/286

FOREIGN PATENT DOCUMENTS

EP 0 662 445 B1 4/1999
JP 5-70048 A 3/1993
WO WO-2006/082275 A2 8/2006

* cited by examiner

*Primary Examiner*—Jonathan Salata
(74) *Attorney, Agent, or Firm*—Birch, Stewart, Kolasch & Birch, LLP

(57) ABSTRACT

An electronic unintended movement governor is disclosed, which includes an input for car position data, a device for determining the speed of the elevator car, a plurality of limit values for permitted movement of the elevator car, such as the limit value of the maximum permitted speed of the elevator car, and which unintended movement governor also provides overspeed monitoring for controlling at least one stopping appliance of the elevator car when the speed of the elevator car exceeds the limit value of the maximum permitted speed. The unintended movement governor includes at least two separate controls for controlling a stopping appliance of the elevator car. Additionally, a method for controlling the aforementioned electronic unintended movement governor is disclosed.

20 Claims, 3 Drawing Sheets

UNINTENDED MOVEMENT GOVERNOR

Figure 1:
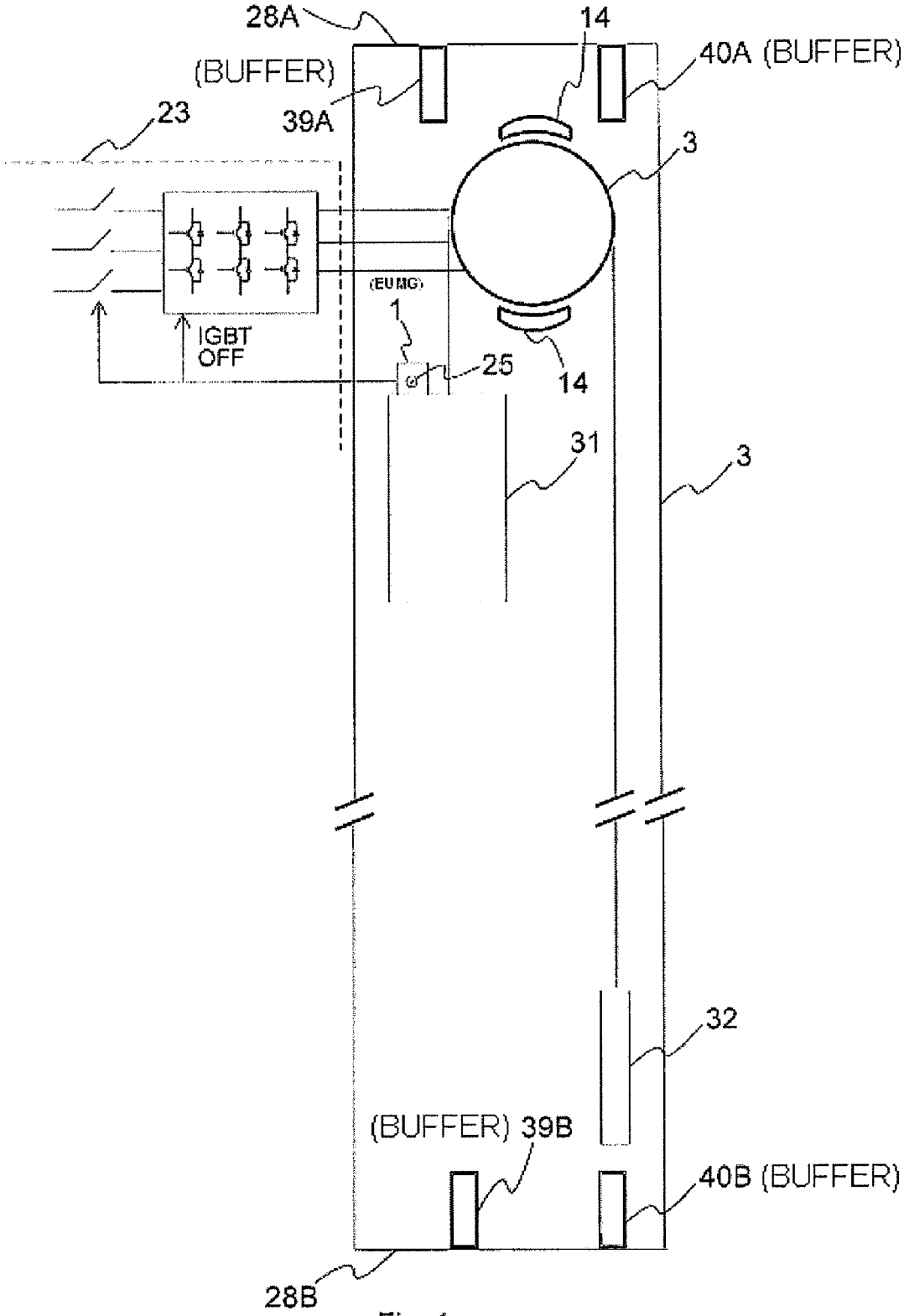

This application is a Continuation of copending PCT International Application No. PCT/FI2008/000026 filed in Finland on Feb. 12, 2008 which designated the United States, and on which priority is claimed under 35 U.S.C. §120. This application also claims priority under 35 U.S.C. §119(a) on Patent Application No. 20070148 filed in Finland on Feb. 21, 2007. The entire contents of each of the above documents is hereby incorporated by reference into the present specification.

FIELD OF THE INVENTION

The object of the present invention is an electronic unintended movement governor and a method for controlling the electronic unintended movement governor.

PRIOR ART

For an elevator system is to be safe for a passenger, the movement of the elevator car in the elevator shaft must be controlled in all operating situations. Movement of the elevator car must be always limited in different varying operating situations, such that the movement remains in the area defined as safe for the specific operating situation. For this reason different limit values for permitted movement of the elevator car must be defined, on the one hand, and it must be ensured that the elevator car remains in the operating environment defined by these limits, on the other hand.

An elevator system contains numerous prior-art safety devices and sensors for monitoring the movement of the elevator car and for ensuring safety. In a normal operating situation, the control system of the elevator handles the driving of the elevator from floor to floor. The elevator shaft contains sensors for this purpose, which indicate the position of the floor. During normal drive, in acceleration and deceleration the control system of the elevator ensures that e.g. the speed of the elevator decreases and that the elevator stops at the position of the right floor. The control system stops the elevator smoothly also at the terminal floor. If normal stopping of the elevator by means of the control system does not work, Normal Terminal Slowdown (NTS) handles the smooth stopping of the elevator at the terminal floor. An extra control unit is added to the control system of the elevator for this purpose, which examines the operation of the normal drive control and when it detects that the control does not start to decelerate normally when approaching the terminal floor bypasses the normal drive control and manages the stopping of the elevator at the terminal floor.

A mechanical overspeed governor (OSG) can be used as a safety device. The overspeed governor monitors the speed of the elevator car in the elevator shaft and if the speed of the elevator car exceeds a certain pre-set limit value, the overspeed governor disconnects the safety circuit of the elevator, in which case the machinery brake engages. The elevator contains a safety circuit, which is cut if any of the switches that are connected to it opens. If the overspeed still increases from the previous, the overspeed governor uses the safety gear that is in connection with the elevator car, the wedge of which grips the guide rails of the elevator and prevents movement of the elevator car. In other words, if the ropes or rope suspensions fail and the elevator car starts to drop freely, the safety gear wedges and grips.

When the elevator car is in the proximity of a landing and the elevator car doors and landing doors are open, it must be ensured that the elevator car is not able to move away from the landing. The moving of the elevator car in this situation would cause a shearing hazard between the elevator car and the aperture of the landing door. This kind of hazardous situation could arise e.g. when the machinery brake fails or when the ropes slip on the traction sheave. For this reason a so-called anti-creep device is added to elevators, which is based on rotation of the wheel of the mechanical overspeed governor being prevented with e.g. a wedge when the elevator car arrives at a landing, such that when the wheel rotates e.g. 90 degrees the wedge locks the wheel and this causes gripping of the elevator car. The control system of the elevator always controls the wedge into its position when the elevator car arrives at a landing.

Publication ES2129088T discloses a prior-art appliance, with which the elevator car is stopped by locking the wheel of the mechanical overspeed governor such that the gripping function is initiated. The drawback of this appliance, however, is that since the wheel of the overspeed governor might rotate 90 degrees before the stopping function is activated, the elevator car might move some 200 mm before it stops. In this case the shearing hazard continues to exist.

Overspeed can also be monitored electrically. For example, a solution is known from publication WO00/39015, in which an electronic overspeed monitoring appliance receives a signal indicating the speed of the car, compares the speed of the car to the speed limit data stored in the memory of the monitoring appliance, and if necessary produces an activation signal, by means of which the brakes of the elevator can be engaged.

Near the end of the elevator shaft is an end limit switch. When the elevator car arrives at an end limit switch, the ramp that is in connection with the elevator car forces open the end limit switch and the safety circuit of the elevator is cut, in which case the machinery brake of the elevator operates and the main contactors of the elevator open.

If the elevator continues onwards a few centimeters from the end limit switch, the car (or correspondingly the counterweight) collides with the buffer, which yields and finally stops the elevator.

The authorities of different countries have different regulations concerning the safety of elevators. The basic principle is that the elevator must contain the kind of safety system that is able to stop the elevator in a fault situation. For example, according to the elevator directive 95/16/EC issued by the European Union, an elevator must contain an overspeed governor as well as a speed monitoring system. The elevator may not reach uncontrolled acceleration of movement or uncontrolled deceleration of movement. Furthermore, the situation in which the elevator car starts to slide out of the landing zone when the doors are open, owing e.g. to rope slipping or a fault situation in the machinery brake, must be avoided.

Publication WO 2006/082275 A2 presents an electronic unintended movement governor, which comprises two separate controls for controlling the stopping appliance of an elevator car, namely a first control for immediately controlling the stopping appliance of the elevator car once the elevator car exceeds the limit value for permitted maximum speed, and a second control for controlling the stopping appliance of the elevator car on the basis of the door zone information received.

Publication JP 5-70048 A presents an electronic unintended movement governor, in which the limit values for the permitted movement of the elevator car comprise a limit value for the distance traveled by the elevator car and a time delay. The electronic unintended movement governor comprises means for determining the distance traveled by the elevator car and a control for stopping the elevator car when the distance traveled by the elevator car or the time delay exceeds the pre-defined limit value.

PURPOSE OF THE INVENTION

The purpose of the present invention is to disclose a new kind of electronic unintended movement governor, with which it is endeavored to ensure that the elevator car moves only in the permitted area and at the permitted speed in the elevator shaft in different, varying operating situations and operating environments. A further purpose of the invention is to disclose a method with which the aforementioned electronic unintended movement governor is controlled so that it is ensured that the elevator car stays in its permitted operating environment.

CHARACTERISTIC FEATURES OF THE INVENTION

The elevator system and the method according to the invention are characterized by what is disclosed in the characterization parts of claims 1 and 14. Other embodiments of the invention are characterized by what is disclosed in the other claims. Some inventive embodiments are also discussed in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments. Furthermore the features that are presented in conjunction with the movement limiter according to the invention can be applied in the method according to the invention, and vice versa.

The electronic unintended movement governor according to the invention comprises an input for the car position data, means for determining the speed of the elevator car, and a plurality of limit values for permitted movement of the elevator car, such as the limit value for the maximum permitted speed of the elevator car. The unintended movement governor also comprises overspeed monitoring for controlling at least one stopping appliance of the elevator car when the speed of the elevator car exceeds the limit value for the maximum permitted speed. The limit values for permitted movement of the elevator car comprise a limit value for the distance traveled by the elevator car as well as a time delay. The electronic unintended movement governor comprises means for determining the distance traveled by the elevator car, as well as at least two separate controls for controlling a stopping appliance of the elevator car, namely: a first control for immediately controlling a stopping appliance of the elevator car, and a second control for controlling a stopping appliance of the elevator car when the distance traveled by the elevator car and/or the time delay exceeds a predefined limit value, and that the control of the stopping appliance of the elevator car comprises a control of the machinery brake as well as a disconnection of the power supply circuit of the motor.

One electronic unintended movement governor according to the invention comprises an input for the position data of the car and possibly for the speed data of the car and/or the traction sheave, means for determining the speed of the elevator car, means for controlling at least one stopping appliance of the elevator car as well as a plurality of limit values for the permitted movement of the elevator car, such as the limit value for the maximum permitted speed of the elevator car. A measuring appliance can also be integrated into the unintended movement governor according to the invention, for measuring the speed and/or position of the elevator car. One unintended movement governor according to the invention comprises overspeed monitoring for controlling at least one stopping appliance of the elevator car when the elevator car exceeds the limit value for maximum permitted speed. In one embodiment of the invention the limit values for the permitted movement of the elevator car comprise a limit value for the distance traveled by the elevator car as well as a time delay. In this embodiment of the invention the electronic unintended movement governor comprises means for determining the distance traveled by the elevator car, a timer and at least two separate controls for controlling the stopping appliance of the elevator car, namely:

- a first control for immediately controlling at least one stopping appliance of the elevator car and
- a second control for controlling at least one stopping appliance of the elevator car when the distance traveled by the elevator car and/or the time delay exceeds a predefined limit value.

The aforementioned controls can be dependent on direction. In this case the electronic unintended movement governor determines the direction of movement of the elevator car on the basis of the speed data or the position data of the elevator car. The control of the stopping appliance of the elevator car is now selected on the basis of the direction of movement of the elevator car such that in the first direction of movement of the elevator car the stopping appliance is controlled with the first control of the stopping appliance and in the second direction of movement with the second control.

In one embodiment of the invention both the limit value for the distance traveled by the elevator car and the time delay are functions of the speed of the elevator car. If the elevator car arrives e.g. at the terminal floor at a great speed, it can be necessary to initiate the stopping function faster than in a case where the speed of the elevator car has already decelerated while approaching the terminal floor. In this case the time delay can be shortened. On the other hand, the stopping distance of the elevator car depends on the speed of the elevator car at the time the machinery brake is controlled. In this case this stopping distance can be taken into account such that the limit value for the distance traveled by the elevator car is increased as the speed of the elevator car grows, and the gripping function does not need to be initiated unnecessarily when the machinery brake operates normally.

In one embodiment of the invention the limit values for the permitted movement of the elevator car in an elevator system with counterweight comprise the extreme limits of the permitted movement of the counterweight in the elevator shaft. The limit values for the permitted movement of the counterweight can be separately defined for normal drive and service drive such that with service drive the limit values restrict the extreme limits of movement of the counterweight in the elevator shaft farther from the end of the shaft than the limit values used during normal drive. When movement of the counterweight near the ends of the shaft is prevented, adequate safe service space in the elevator shaft is simultaneously ensured. The elevator system according to the invention can also be one without counterweight, in which case these limit values are not of course needed.

The electronic unintended movement governor according to the invention uses the speed data and/or the position data of the elevator car as monitoring information. These data can be measured in a number of different ways. In one embodiment of the invention the position is measured from a magnetic strip disposed in the elevator shaft in the direction of travel of the elevator car by means of Hall sensors that react to the magnetic field of the strip. In another embodiment of the invention prior-art RFID sensors are disposed in the elevator shaft, which according to their location specify different position data of the elevator shaft, such as floor information or end limit information. The position and speed of the elevator car can also be measured with a prior-art absolute encoder situated in connection with the elevator car, which gives pulse-shaped or DC voltage information about the position of the elevator car.

In one embodiment of the invention the overspeed monitoring functions such that the speed of the elevator car is compared to the limit value for the maximum permitted speed and if the speed exceeds this limit value, the stopping appliance of the elevator car is controlled with the electronic unintended movement governor. The stopping appliance can be a stopping appliance connected to the guide rail of the elevator car or it can also be a machinery brake connected to the hoisting machine, such as to the traction sheave of the elevator motor.

The overspeed monitoring can also be multiple phase such that when the speed of the elevator car exceeds the first limit value for speed the first stopping appliance, such as the machinery brake, is controlled, and when the speed of the elevator car exceeds the second limit value for speed, which is of an absolute value greater than first limit value for speed, the second stopping appliance, such as a guide rail brake or safety gear that stops the elevator car, is controlled. The aforementioned limit values for the speed of the elevator car can also vary as a function of the position of the elevator car e.g. such that closer to the end of the elevator shaft the limit values are of a smaller absolute value. Furthermore the limit values can vary according to the desired set value for the speed of the elevator car such that the absolute values of the limit values are always greater than the absolute value of the speed reference, in accordance either with a predetermined constant or with a scaling factor that is greater than one.

In one embodiment of the invention the overspeed governor comprises a first input for the first activation signal, with which the first control for immediately controlling a stopping appliance of the elevator car is activated, and a second input for a second activation signal, with which the second control for controlling the stopping appliance of the elevator car when the distance traveled by the elevator car and/or the time delay exceeds a predefined limit value. The time delay in the unintended movement governor according to the invention can also receive the value of zero.

The unintended movement governor according to the invention can also comprise an input for the mode signal of the elevator system, which mode signal comprises at least information about the service drive mode of the elevator system. The input can comprise information also about other modes of the elevator system, such as the construction-time use of the elevator system mode or emergency drive mode.

One unintended movement governor according to the invention comprises an output for a signal, which indicates the speed data of the elevator car and/or the position data of the elevator car. This data can be transmitted to the elevator control system.

The unintended movement governor according to the invention can comprise an output for a signal that indicates the operating status of the unintended movement governor. The elevator control system can read this signal and it can in a controlled manner stop the elevator under the control of the signal data at the nearest floor, or if the signal data necessitates it, the elevator car can be driven as fast as possible with slowdown ramps to stops.

The electronic unintended movement governor according to the invention can comprise a serial interface circuit, with which it is possible to send to the elevator control system as a serial interface signal information about the speed and/or position data of the elevator car as well as possibly information about the operating status of the unintended movement governor.

One unintended movement governor according to the invention can comprise means for controlling the machinery brake and possibly for disconnecting the power input circuit of the motor. The means can comprise a switch connected to the safety circuit of the elevator, the opening of which causes disconnection of the safety circuit, as a result of which the power input circuit of the motor disconnects and the machinery brake engages. These controls can be used in an elevator system also in reporting the operating status of the unintended movement governor: when the safety circuit switch controlled by the unintended movement governor is closed, the elevator control system can assume that the unintended movement governor is in operating condition.

One unintended movement governor according to the invention comprises a non-volatile memory, in which at least information about drive prevention of the elevator is recorded. The memory can be any prior-art flash memory or EEPROM memory whatsoever, the information in which is retained over a power outage. In addition, the unintended movement governor can include power outage security to ensure the operation of the non-volatile memory. This means that when the battery backup fails during a power outage, the operating voltage of the unintended movement governor is first extinguished. When the operating voltage returns the unintended movement governor remains in the drive prevented mode, in which case the serviceman must manually visit, e.g. by changing the state of the switch that is in connection with the unintended movement governor, releasing the drive prevented mode. Only after this does the unintended movement governor permit movement of the elevator car.

A manually-operated switch is in connection with one unintended movement governor according to the invention for resetting drive prevention of the elevator. The unintended movement governor can be switched to drive prevented mode always when controlling a stopping appliance of the elevator car. In this case the serviceman must as a consequence of the operation of the stopping appliance always visit resetting with the elevator the drive prevented mode and at the same time ensuring the safe operation of the elevator system.

In one unintended movement governor according to the invention the limit values for permitted movement in the elevator shaft comprise first limit values for the extreme limits of movement of the elevator car in the elevator shaft in service drive mode as well as second limit values for the extreme limits of movement of the elevator car in the elevator shaft in normal drive mode. The first limit values restrict the extreme limits of movement of the elevator car in the elevator shaft farther from the end of the shaft than the second limit values to ensure an adequate and safe service space in the elevator shaft in service drive mode.

In the unintended movement governor according to the invention the input for car position data can comprise an input for the end limit identifier data of the elevator shaft.

The limit values for movement permitted by one unintended movement governor according to the invention comprise limit values for the extreme limits of movement of the elevator car in the elevator shaft during construction-time use. During construction-time use it is necessary to move with the elevator in the elevator shaft e.g. when installing guide rails. In this case some of the guide rails can still be missing, and movement of the elevator car is limited to only a part of the elevator shaft. When movement of the elevator car outside the permitted area is also prevented during construction time by controlling if necessary at least one stopping appliance of the elevator car, the safety of construction-time use improves.

Sometimes water can accumulate on the bottom of the elevator shaft. If enough water accumulates on the bottom of the shaft there is a danger that the elevator car can collide with a pool of water. If this kind of danger exists, a flood sensor can be installed on the bottom of the shaft, which detects accumulated water. On the basis of the sensor data the movement of the elevator car in the vicinity of the bottom of the shaft can be limited to prevent collision. In this case the limit values for movement permitted by the electronic unintended movement governor can comprise separate limit values as a contingency for this kind of flood situation.

One unintended movement governor according to the invention comprises an input for two car position data that are independent of each other and possibly for two car speed data that are independent of each other. In this case two separate measured speed/position data can be compared to each other in the unintended movement governor and thus the correctness of the measurements can be ensured.

One unintended movement governor according to the invention comprises means for locking the wheel of the mechanical overspeed governor. When the wheel of the overspeed governor is locked, the safety gear connected via ropes to the overspeed governor starts to brake the movement of the elevator car. An advantage is gained from this when it is desired to control the mechanical overspeed governor at lower speeds than the pre-set operating speed of the overspeed governor.

One unintended movement governor according to the invention comprises means for controlling the braking device connected to the guide rail. The aforementioned braking device can be some prior-art guide rail brake or safety gear or other braking device, which comprises a power-assisted control. Power-assisted control means a control which when activated operates irreversibly and removal of the control requires manual retuning of the control appliance.

In the method according to the invention for controlling an electronic unintended movement governor: the position data of the elevator car is measured; the speed data of the elevator car is determined on the basis of the measurement and the speed data is compared to the limit value for maximum permitted speed; in which case when the speed exceeds the maximum permitted limit value at least one stopping appliance of the elevator car is controlled; at least the machinery brake is controlled and the power input circuit of the motor is disconnected immediately the first control is activated; or when the second control is activated the passage of the time delay is determined, and after the time delay: the distance traveled by the elevator car is determined by measuring the change in the position data of the car; and when the distance traveled exceeds the predefined limit value for distance at least the machinery brake is controlled and the power input circuit disconnected.

In one method for controlling the electronic unintended movement governor according to the invention the elevator car position data and possibly the speed data of the elevator car is read, the speed data of the elevator car is determined and the speed data is compared to the limit value for the maximum permitted speed. The speed data can be determined from the position information of the elevator car with a prior-art method by measuring the change in position as a function of time. When the speed of the elevator car exceeds the limit value for maximum permitted speed a stopping appliance of the elevator car is controlled. There can also be numerous limit values for maximum permitted speed, and it is possible to control different stopping appliances of the elevator car as a result of exceeding the different limit values. For example, the machinery brake can be controlled when the speed of the elevator car exceeds the first limit value and the safety gear of the elevator car can be controlled when the speed exceeds a second limit value that has a greater absolute value than the first limit value. In one method according to the invention for controlling the electronic unintended movement governor the stopping appliance of the elevator car is controlled immediately when the first control is activated. If on the other hand the second control activates, when this control is activated the passage of any time delay is determined with a timer, and after the possible time delay the distance traveled by the elevator car is determined by measuring the change in the position data of the car and when the distance traveled exceeds the predefined limit value for distance a stopping appliance of the elevator car is controlled. The aforementioned time delay can also be zero, in which case in this method according to the invention the time delay is not measured at all.

In another method according to the invention the first and the second activation signals are read. A first control for immediately controlling a stopping appliance of the elevator is activated according to the first activation signal. A second control for controlling a stopping appliance of the elevator car is activated, on the other hand, according to the second activation signal, and the stopping appliance of the elevator car is controlled in this case when the distance traveled by the elevator car and the possible time delay exceed the predefined limit values.

In one method according to the invention information is read about the position of the elevator car in the elevator shaft. At the same time a mode signal of the elevator system is read and on the basis of the signal the mode of the elevator system is deduced. By means of the mode thus read, a stopping appliance of the elevator car is controlled such that in service drive mode the position data of the elevator car is compared to the extreme limits for movement in the elevator shaft in service drive mode and when it is detected that the elevator car has arrived at the extreme limit a stopping appliance of the elevator car is controlled according to, optionally, the first control or the second control. In normal drive mode, on the other hand, the position data of the elevator car is compared to the extreme limits for movement in the elevator shaft in service drive mode and when it is detected that the elevator car has arrived at the extreme limit a stopping appliance of the elevator car is controlled according to the first control. Service drive mode means a mode into which the elevator system is switched e.g. for servicing procedures. This mode can be switched on e.g. such that the control system of the elevator checks the manually-operated service drive switch and when it detects that the state of the switch has changed to the position required for service drive mode, the control system switches or is switched to service drive mode. Switching to service drive mode can also occur e.g. such that the control system of the elevator checks the position of the landing doors and possibly of the car doors and on the basis of their position deduces that a person has moved into the elevator shaft. A person moving into the elevator shaft thus can occur e.g. by opening the landing door manually with a special service key. When the person has moved into the elevator shaft the elevator system automatically switches in this case to service drive mode. Normal drive mode, on the other hand, means the normal operating state of the elevator, in which case it serves passengers by receiving landing calls and by driving from one floor to another according to the calls.

In one method according to the invention the unintended movement governor comprises a non-volatile memory and a manually-operated switch. In this method after the control of the stopping appliance of the elevator car the next run is prevented by switching to the drive prevented mode of the unintended movement governor and by recording this information in the non-volatile memory of the unintended movement governor. In the method also the manually-operated switch is read and when the position of the switch is changed to allow cancellation of prevention mode the drive prevented mode is cancelled. Drive prevented mode means a state in which the unintended movement governor endeavors to prevent all movement of the elevator car by controlling some prior-art stopping appliance of the elevator car, such as a safety gear. If the safety gear is tuned manually but the drive prevented mode is not cancelled, the electronic unintended movement governor endeavors to control the safety gear immediately again and thus to prevent movement of the elevator car.

In one method according to the invention when the unintended movement governor has switched to drive prevented mode information about the drive prevented mode is sent as an output signal, which indicates the operating status of the unintended movement governor. When the unintended movement governor has switched to drive permitted mode, on the other hand, information about the drive permitted mode is sent as an output signal, which indicates the operating status of the unintended movement governor.

The aforementioned signals handled by the inputs and outputs of the electronic unintended movement governor can be parallel formed or serial interface formed signals. Additionally the signals can also be switch outputs and switch inputs of the relay, in which case they can be fitted into the safety circuit of the elevator. The aforementioned electronic unintended movement governor can be used in the kind of elevator system in which a prior-art elevator safety circuit does not exist, but instead has been replaced with separate electronic safety devices. The electronic unintended movement governor can also be one of these electronic safety devices.

ADVANTAGES OF THE INVENTION

The electronic unintended movement governor enables the movement of the elevator car in the elevator shaft to be centrally monitored and limited to a permitted area by means of a single safety device. The unintended movement governor can contain different limit values for permitted movement that vary for the different operating situations and operating environments, but movement of the elevator car is stopped in all operating situations always with the same safety-approved control method, using a safety-approved stopping appliance, such as a safety gear. This improves the safety and reliability of the elevator system. Likewise it simplifies the elevator system, because different mechanical safety functions and safety devices can be integrated into one entity. Likewise it is possible to manage the safety of the elevator system in normal drive mode as well as in service drive mode, as well as, for instance, during construction-time use or during a water leakage.

The electronic unintended movement governor according to the invention can also be disposed as a part of an existing elevator system, e.g. in conjunction with modernization of an elevator system. The unintended movement governor can be connected to an elevator system in connection with a previously incorporated mechanical overspeed governor, In which case the safety functions integrated into the unintended movement governor can be taken into use quickly and cost-effectively in a modernized elevator. Furthermore, in modernization there is also no need in this case to install new mechanical braking appliances in the elevator system.

Since the electronic unintended movement governor determines the movement of the elevator car constantly, the stopping function becomes more accurate when compared to e.g. a prior-art solution in which a mechanical overspeed governor operates discretely with respect to the wheel of the overspeed governor and tripping occurs e.g. at 90 degree intervals on the wheel of the overspeed governor.

The electronic unintended movement governor according to the invention is easy to connect to an elevator control system and the interface can be very simple as defined in the invention, containing at its simplest just two separate control data (a first and a second control signal) and one feedback data about the operating status of the unintended movement governor to the elevator control system.

Since the movement of the elevator car in the vicinity of the ends of the elevator shaft are monitored and restricted by controlling a stopping appliance of the elevator car, it is possible to ensure that the elevator car does not drive onto the end buffers in an uncontrolled manner. In this case the dimensioning of the buffers can be made lighter, which saves costs.

PRESENTATION OF DRAWINGS

Figure 2:
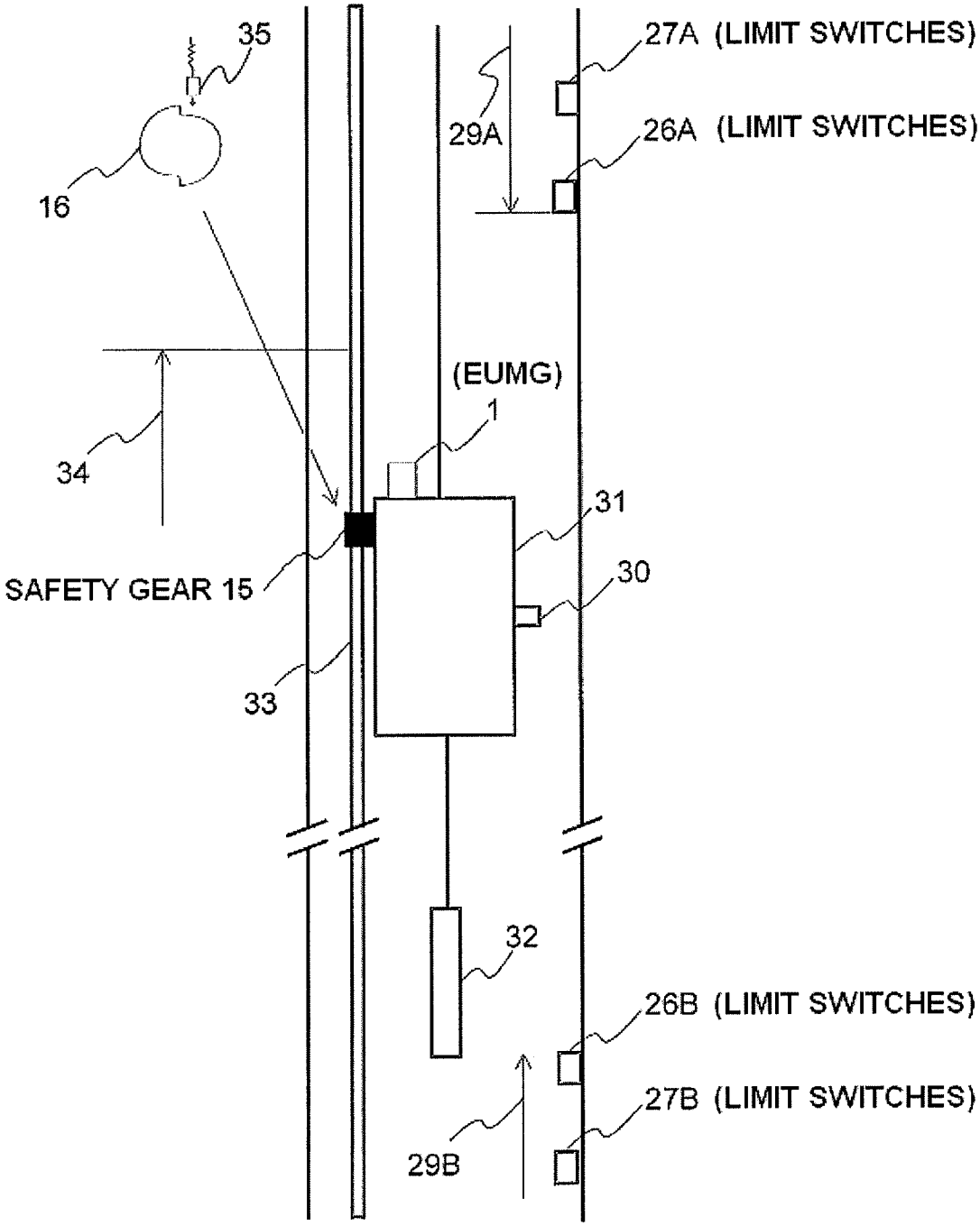
Figure 3:
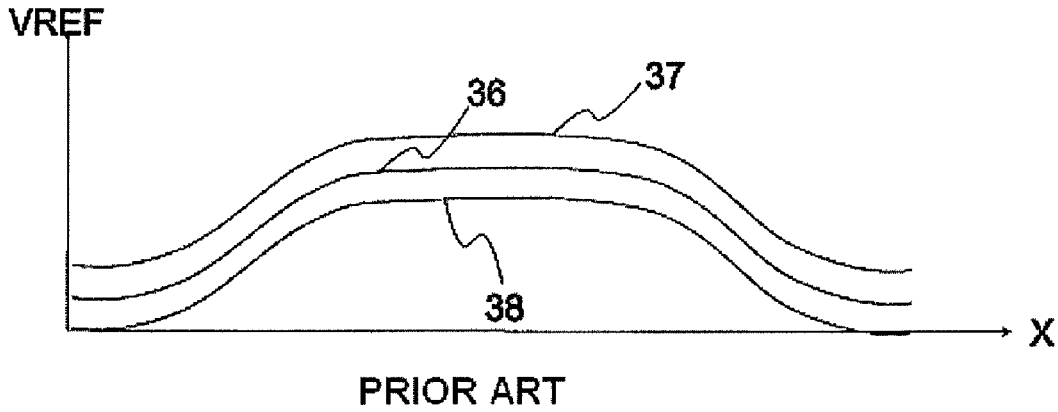
Figure 4:
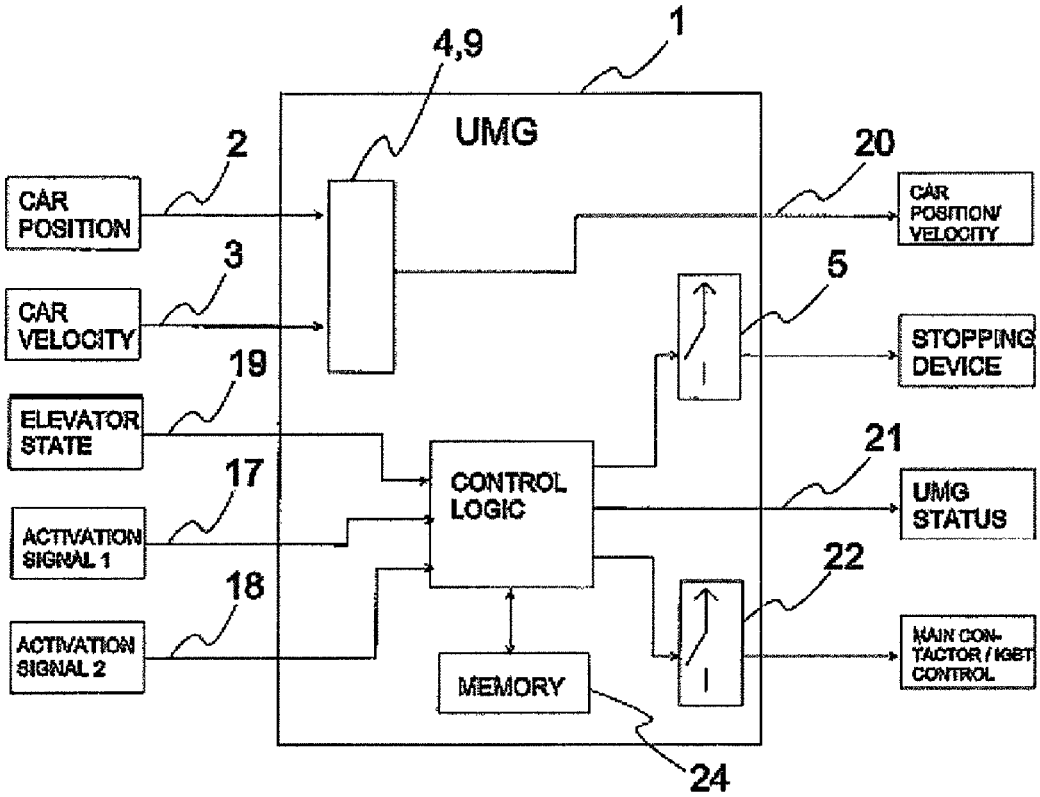

In the following, the invention will be described in more detail by the aid of some of its embodiments with reference to the attached drawings, wherein FIG. 1 presents an elevator system viewed from a first direction, to which is fitted the safety appliance according to the invention FIG. 2 presents an elevator system viewed from a second direction, to which is fitted the safety appliance according to the invention FIG. 3 presents the operation of one safety device according to prior art FIG. 4 presents an electronic unintended movement governor (UMG) according to the invention FIG. 1 presents an elevator system viewed from a first direction, to which is fitted the electronic unintended movement governor according to the invention. The elevator car 31 and the counterweight 32 are moved with the elevator motor 42. The motor receives its power supply from the power input circuit 23, which comprises, among other things, a main contactor and a frequency converter used to control the elevator motor. The elevator car moves in the shaft 3 in a fairly vertical direction. A buffer 39A for the elevator car 31 and a buffer 40A for the counterweight 32 are installed at the top end 28A of the elevator shaft 41. Correspondingly, buffers 39B and 40B for the elevator car 31 and the counterweight 32 are installed at the bottom end 28B of the elevator shaft 3. It is endeavored by means of the buffers to dampen a collision in a situation in which the elevator car or the counterweight drives to the end in an uncontrolled manner. In this embodiment of the invention an electronic unintended movement governor (EUMG) 1 is disposed on the elevator car 31. In a preferred embodiment of this invention the unintended movement governor is in connection with the power input circuit 23 of the elevator motor 42 and the unintended movement governor can disconnect the power input circuit by opening the main contactor and by preventing control of the IGBT transistors used as the control switches of the frequency converter. Also fitted in connection with the unintended movement governor 1 is a manually-operated switch 25, by changing the state of which it is possible to switch the unintended movement governor 1 out of the drive prevented mode.

FIG. 2 presents an elevator system according to FIG. 1 viewed from a second direction. The elevator car moves along the guide rails 33. This elevator system according other invention comprises two stopping appliances of the elevator ca a machinery brake 14 and safety gear 15. In addition the elevator system contains a mechanical overspeed governor 16, which in an overspeed situation trips the safety gear via ropes. A solenoid 35 is in connection with the wheel of the mechanical overspeed governor, which the electronic unintended movement governor 1 controls locking the wheel of the overspeed governor, in which case the gripping function is initiated under the control of the electronic unintended movement governor. Two sets of end limit switches are situated near the ends of the elevator shaft, one set 27A and 27B for a normal drive mode and the other set 26A and 26B for a service drive mode. A safe service space 29A in the top part of the elevator shaft 3 as well as a safe service space 29B in the bottom part of the elevator shaft 3 is restricted with the limit switch for the service drive mode. In this regard, the electronic unintended movement governor reads the mode of the elevator system from the elevator control system and when it detects that the elevator system has switched to service drive mode it takes the service drive limit switches 26A and 26B into use. When the electronic unintended movement governor detects via the reader 30 in connection with the elevator car that the elevator car has moved at the location of the service drive limit switches 26A or 26B, the unintended movement governor controls the safety gear (not shown) by locking the wheel of the mechanical overspeed governor 16, the elevator car stops and is locked into its position. The electronic unintended movement governor 1 contains two separate controls for controlling the safety gear. The safety gear can be controlled according to the first control, in which case gripping starts immediately the elevator car reaches the service drive limit switch, or the safety gear can be controlled after a predetermined delay and in addition the elevator car is still permitted to move after this to the extent of a predetermined limit value for movement of the elevator car. The delay can also be zero, in which case the unintended movement governor starts to measure the distance traveled by the elevator car immediately it arrives at the service drive limit switch, and when the distance exceeds a predefined limit value, gripping is initiated. In addition, different limit values for permitted movement were in use in the elevator system in question during construction time, which were set by the extreme limits of permitted movement of the elevator car and counterweight in the elevator shaft during construction-time. During construction time the elevator car is often used as an aid in construction work, e.g. when installing the guide rails 33. In this case it must be possible to move safely with the elevator car in a limited area in the elevator shaft also e.g. in the situation in which the guide rails are installed in only a part of the elevator shaft. FIG. 2 presents by way of an example a construction-time situation, in which the limit values for the movement permitted by the electronic unintended movement governor restrict the extreme limits of movement of the elevator car to below the limit position 34. If the elevator car arrives at the limit position 34, above which installation of the guide rails is in progress, the electronic unintended movement governor controls the safety gear and prevents movement of the elevator car away from the safe area set by the limit values.

Another embodiment of the invention does not contain the separate limit switches 26, 27, but instead the unintended movement governor determines the position of the elevator car in the elevator shaft and compares it to the limit values for permitted movement, which set the extreme limits of movement of the elevator car in the elevator shaft both in normal drive mode and in service drive mode. The limit values for service drive mode set the extreme limits of movement farther from the ends 28 of the elevator shaft than the limit values for normal drive mode, in which case it is possible to ensure adequate service spaces in the vicinity of the ends of the elevator shaft.

The limit values for movement of the elevator car permitted by the electronic unintended movement governor can also comprise limit values for the maximum permitted speed of the elevator car. In this case the unintended movement governor can monitor the speed of the elevator car like a prior-art overspeed governor.

FIG. 3 presents the operation of one prior-art overspeed governor in normal drive mode. Graph 38 presents the set value for the speed of the elevator car, i.e. the speed reference (VREF) as a function of the position (X) of the elevator car in the elevator shaft. Graphs 36 and 37 present two different limit values for maximum permitted speed, which vary as a function of the position (X) of the elevator car in the elevator shaft. Before starting, the elevator car is situated at a floor, at the point of the elevator shaft X=0. After starting the elevator car accelerates according to the speed reference 38 to a steady speed, and on approaching the floor braking of the elevator car is started, such that it continues to follow the speed reference. At a certain point in the elevator shaft deceleration of the elevator car is started and it is endeavored to stop it according to the speed reference at the floor which is situated at the point in the elevator shaft $X=X_1$. If the measured speed of the elevator car grows during a run past the first limit value for speed 36, it is endeavored to stop the elevator car by controlling the elevator car machinery brake. If the speed nevertheless continues to grow past the second limit value for speed 37, the safety gear of the elevator car is also controlled.

FIG. 4 presents an electronic unintended movement governor 1 (UMG=unintended movement governor) according to the invention. The unintended movement governor comprises inputs for the position information 2 (CAR POSITION) of the elevator car, for the speed information 3 (CAR VELOCITY) of the elevator car, for the status signal 19 (ELEVATOR STATE) of the elevator system, for the first control signal 17 (ACTIVATION SIGNAL 1) for activating the first control, and for the second control signal 18 (ACTIVATION SIGNAL 2) for activating the second control. The outputs of the electronic unintended movement governor are the position signal and/or the speed signal 20 (CAR POSITION/VELOCITY) of the elevator car, as well as the signal 21 (UMG STATUS) indicating the operating status of the electronic unintended movement governor. The unintended movement governor also comprises means 5 for controlling at least one stopping appliance of the elevator car (STOPPING DEVICE) as well as means 22 for disconnecting the power input circuit of the motor (MAIN CONTACTOR/IGBT CONTROL). In this preferred embodiment of the invention the means 5 and 22 are the contacts of a relay, which are controlled by the overspeed governor. The stopping appliance of the elevator car is controlled with the means 5, which can be a guide rail brake. The power supply to the magnetic circuit of the guide rail brake can be disconnected with the contact of the relay, in which case the braking function is initiated. The means 22 comprise a contact, with which the coil of the main contactor can be controlled. When the contact opens, current supply to the coil is prevented and the main contactor opens. The unintended movement governor also comprises means 4 for determining the speed of the elevator car as well as means 9 for determining the distance traveled by the elevator car. The speed of the elevator car can be determined on the basis of the measurement 2 of the elevator car position data with prior-art monitoring of the change of position, or it can be measured directly with the measurement 3. In addition the electronic unintended movement governor comprises a control logic (CONTROL LOGIC) as well as a non-volatile memory 24 (MEMORY). The desired control of the electronic unintended movement governor is activated by means of the first 17 or the second 18 control signal. A first control for immediately controlling at least one stopping appliance of the elevator car is activated by means of a first control signal. In this preferred embodiment of the invention a prior-art safety gear is used as the stopping appliance. The second control for controlling the stopping appliance of the elevator car is activated by means of the second control signal, in which case measurement of any pre-determined time delay is started, and when the time delay has passed determination of the distance traveled by the elevator car is started. When the distance exceeds a predefined limit value the elevator car is stopped by controlling the safety gear. The second control can be activated e.g. when the elevator car is standing at the landing, in which case it can be ensured by means of the control that the elevator car is not able to move away from the landing e.g. when the machinery brake fails or when the ropes slip on the traction sheave.

It is obvious to the person skilled in the art that the invention is not limited solely to the example described above, but that it may be varied within the scope of the claims presented below. It is also obvious to a person skilled in the art that the functional parts of the aforementioned unintentional movement governor do not necessarily need to be separate but they can be integrated directly into the control system of the elevator.

The invention is not limited to the embodiments described above, in which the invention is described using examples, but rather many adaptations and different embodiments of the invention are possible within the scope of the inventive concept defined by the claims presented below.

The invention claimed is:

1. An electronic unintended movement governor for an elevator system that includes an elevator car, a mechanical overspeed governor and at least one mechanical overspeed governor controlled stopping appliance, comprising:

an input for elevator car position data;

a device that determines the speed of the elevator car;

a plurality of limit values for permitted movement of the elevator car, including a limit value of the maximum permitted speed of the elevator car;

wherein the limit values for the permitted movement of the elevator car comprise a limit value for the distance traveled by the elevator car as well as a time delay, and the electronic unintended movement governor further comprises a device that determines the distance traveled by the elevator car, a timer, and at least two separate controls that control a stopping appliance of the elevator car, said at least two separate controls comprising:

a first control for immediately controlling at least one stopping appliance of the elevator car; and a second control for controlling the mechanical overspeed governor to control at least one stopping appliance of the elevator car when the distance traveled by the elevator car and/or the time delay exceeds a predefined limit value, and wherein the control of the stopping appliance of the elevator car comprises a control of a machinery brake as well as a disconnection of a power input circuit of an elevator car drive motor.

2. The unintended movement governor according to claim 1, wherein the unintended movement governor comprises a first input for a first activation signal, with which the first control for immediately controlling a stopping appliance of the elevator car is activated, and a second input for a second activation signal, with which the second control for controlling the stopping appliance of the elevator car is activated when the distance traveled by the elevator car and/or the time delay exceeds a predefined limit value.

3. The unintended movement governor according to claim 1, wherein the unintended movement governor comprises an input for the mode signal of the elevator system, which mode signal comprises at least information about a service drive mode of the elevator system.

4. The unintended movement governor according to claim 1, wherein the unintended movement governor comprises a signal output, which indicates the elevator car speed data and/or the elevator car position data.

5. The unintended movement governor according to claim 1, wherein the unintended movement governor comprises a signal output indicating the operating status of the unintended movement governor.

6. The unintended movement governor according to claim 1, wherein the unintended movement governor comprises a non-volatile memory, which is adapted to record at least information about drive prevention of the elevator.

7. The unintended movement governor according to claim 1, further comprising in connection with the unintended movement governor a manually-operated switch for setting a drive prevention mode of the elevator.

8. The unintended movement governor according to claim 1, wherein the limit values for permitted movement of the elevator shaft comprise first limit values for extreme limits of movement of the elevator car in the elevator shaft in a service drive mode as well as second limit values for extreme limits of movement of the elevator car in the elevator shaft in a normal drive mode, and wherein the first limit values restrict the extreme limits of movement of the elevator car in the elevator shaft farther from the ends of the shaft than do the second limit values to ensure a service space in the elevator shaft in the service drive mode.

9. The unintended movement governor according to claim 1, further comprising an input for car position data that comprises an input for an end limit identifier data of the elevator shaft.

10. The unintended movement governor according to claim 1, wherein the limit values for permitted movement comprise limit values for extreme limits of movement of the elevator car in an elevator shaft during construction-time use.

11. The unintended movement governor according to claim 1, wherein the unintended movement governor comprises an input for two car position data that are independent of each other and/or for two car speed data that are independent of each other.

12. The unintended movement governor according to claim 1, wherein the unintended movement governor comprises a device that locks the wheel of a mechanical overspeed governor.

13. The unintended movement governor according to claim 1, wherein the unintended movement governor comprises a device that controls a braking appliance connected to the guide rail.

14. A method for controlling an electronic unintended movement governor for an elevator system that includes an elevator car, a mechanical overspeed governor and at least one mechanical overspeed governor controlled stopping appliance, said method comprising the steps of:

measuring position data of an elevator car and speed data of the elevator car;

comparing the speed data to a limit value for a maximum permitted elevator car speed;

when the measured elevator car speed exceeds the maximum permitted elevator car limit value, controlling at least one mechanical overspeed governor controlled stopping appliance of the elevator car;

controlling at least an elevator car brake and disconnecting a power input circuit for an elevator drive motor immediately when a first control for immediately controlling a stopping appliance of the elevator car is activated or when a second control for controlling the mechanical overspeed governor to control at least one mechanical governor controlled stopping appliance when the distance traveled by the elevator car and/or a time delay value exceeds a predefined limit value is activated determining the passage of the time delay and after the time;

determining a distance traveled by the elevator car by measuring a change in car position data; and controlling at least the elevator car brake and disconnecting the power input circuit when the distance traveled exceeds the predefined limit value for distance.

15. The method according to claim 14, wherein the method further comprises the steps of:

reading a first and a second activation signal;

activating a first control for immediately controlling at least one stopping appliance of the elevator according to the first activation signal; or activating a second control for controlling at least one stopping appliance of the elevator car according to the second activation signal; and controlling a stopping appliance of the elevator car when the distance traveled by the elevator car and a any time delay exceed the predefined limit values.

16. The method according to claim 15, wherein the method further comprises the steps of:

reading information about the a position of the elevator car in the elevator shaft;

reading a mode signal of the elevator system and on the basis of the signal deducing the mode of the elevator system;

controlling at least one stopping appliance of the elevator car as follows:

in a service drive mode comparing the position information of the elevator car to extreme limits for movement of the elevator car in the elevator shaft in a service drive mode and when it is detected that the elevator car has arrived at an extreme limit, controlling at least one stopping appliance of the elevator car according to the first control or the second control; and in a normal drive mode comparing the position information of the elevator car to extreme limits for movement in the elevator shaft in a normal drive mode and, when it is detected that the elevator car has arrived at an extreme limit, controlling at least one mechanical governor controlled stopping appliance of the elevator car according to the first control.

17. A method for controlling an electronic unintended movement governor, said method comprising the steps of:

measuring position data of the elevator car and speed data of the elevator car;

determining the speed data of the elevator car on the basis of the measurement and comparing the speed data to a limit value for the maximum permitted speed;

when the speed exceeds the maximum permitted limit value, controlling at least one stopping appliance of the elevator car;

controlling at least the machinery brake and disconnecting the power input circuit immediately when the first control is activated or when the second control appliance is activated determining the passage of the time delay and after the time;

determining the distance traveled by the elevator car by measuring the change in the car position data;

controlling at least the machinery brake and disconnecting the power input circuit when the distance traveled exceeds the predefined limit value for distance.

reading the first and the second activation signal;

activating a first control for immediately controlling at least one stopping appliance of the elevator according to the first activation signal; or activating a second control for controlling at least one stopping appliance of the elevator car according to the second activation signal; and controlling a stopping appliance of the elevator car when the distance traveled by the elevator car and a possible time delay exceed the predefined limit values wherein the method comprises a non-volatile memory as well as a manually-operated switch and the method further comprises the steps of:

after control of the at least one stopping appliance of the elevator car, preventing a next run by switching to a drive prevented mode of the unintended movement governor and recording this information in the non-volatile memory of the unintended movement governor; and reading the manually-operated switch and when a position of the switch is changed to allow cancellation of the drive prevention mode, cancelling the drive prevention mode.

18. The method according to claim 15 wherein the method further comprises the steps of:

when the unintended movement governor has switched to a drive prevention mode, sending information about the drive prevented mode as an output signal, which indicates an operating status of the unintended movement governor; and when the unintended movement governor has switched to a drive permitted mode, sending information about the drive permitted mode as an output signal, which indicates an operating status of the unintended movement governor.

19. The unintended movement governor according to claim 2, wherein the unintended movement governor comprises an input for a mode signal of the elevator system, which mode signal comprises at least information about a service drive mode of the elevator system.

20. The unintended movement governor according to claim 2, wherein the unintended movement governor comprises an output for a signal, which indicates the elevator car speed data and/or the elevator car position data.

* * * * *